US009849678B2

(12) United States Patent
Sakai et al.

(10) Patent No.: US 9,849,678 B2
(45) Date of Patent: Dec. 26, 2017

(54) LIQUID DISCHARGER INCLUDING A HEAD, A CAP, A BELT, AND A BELT CLEANER

(71) Applicants: Keitaroh Sakai, Kanagawa (JP); Toshitaka Osanai, Kanagawa (JP); Nobuyuki Akaishi, Kanagawa (JP); Shigeru Morinaga, Kanagawa (JP)

(72) Inventors: Keitaroh Sakai, Kanagawa (JP); Toshitaka Osanai, Kanagawa (JP); Nobuyuki Akaishi, Kanagawa (JP); Shigeru Morinaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/282,582

(22) Filed: Sep. 30, 2016

(65) Prior Publication Data

US 2017/0100936 A1 Apr. 13, 2017

(30) Foreign Application Priority Data

Oct. 7, 2015 (JP) ..... 2015-199315

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/16511; B41J 2/16517; B41J 2/16523; B41J 2/16526; B41J 2/16532; B41J 2/16541; B41J 2/16552
See application file for complete search history.

(56) References Cited

U.S. PATENT DOCUMENTS

| | | | | |
|---|---|---|---|---|
| 2006/0290738 | A1 | 12/2006 | Kusunoki et al. | |
| 2007/0052750 | A1 | 3/2007 | Tokuno et al. | |
| 2007/0200893 | A1* | 8/2007 | Nakashima | B41J 2/16547 347/33 |
| 2007/0206048 | A1 | 9/2007 | Kusunoki et al. | |
| 2008/0291240 | A1 | 11/2008 | Ohsako et al. | |
| 2014/0184690 | A1* | 7/2014 | Miyamoto | B41J 2/16523 347/30 |
| 2015/0360190 | A1 | 12/2015 | Sakai et al. | |

FOREIGN PATENT DOCUMENTS

JP 2011-025621 2/2011

* cited by examiner

*Primary Examiner* — Juanita D Jackson
(74) *Attorney, Agent, or Firm* — Oblon, McClelland, Maier & Neustadt, L.L.P.

(57) ABSTRACT

A liquid discharger includes a head to discharge liquid droplets, a cap to cover a nozzle face of the head; a cap mover to move the cap to a capping position at which the cap faces the nozzle face of the head or to move the cap to an evacuation position at which the cap does not face the nozzle face of the head. Further, there is a belt arranged to face and clean the cap at the evacuation position, the belt having a width and length enough to cover whole area of a rim of the cap; a conveyer to drive the belt, and a belt cleaner which faces the belt to clean the belt.

12 Claims, 6 Drawing Sheets

LIQUID DISCHARGER INCLUDING A HEAD, A CAP, A BELT, AND A BELT CLEANER

CROSS-REFERENCE TO RELATED APPLICATIONS

The present application claims priority from Japanese patent application numbers 2015-199315, filed on Oct. 7, 2015, the entire contents of which are incorporated by reference herein.

BACKGROUND OF THE INVENTION

Field of the Invention

The present invention relates to a liquid discharger, and in particular relates to a liquid discharger including a head to discharge liquid droplets.

Description of the Related Art

As an image forming apparatus such as a printer, a facsimile machine, a copier, a plotter, and a multifunction apparatus combining several of the capabilities of the above devices, a liquid discharger, such as an inkjet recording apparatus, using a liquid discharging recording method employing a recording head that discharges ink droplet is known.

Such a liquid discharger has a head that discharges liquid droplet from nozzles. A discharge failure may occur for several reasons. For example, a solvent in liquid evaporates from the nozzles which increases the viscosity of liquid in the nozzles. A discharge failure also occurs due to the solidification of the liquid in the nozzles and by attachment of dust on the nozzles.

A cap that covers the nozzle face is used for cleaning the nozzles and retaining moisture in the nozzle. Also, a cap cleaning apparatus, such as cap stamper, is used for cleaning the cap.

The parts of the cap cleaner, such as stamper, which contacts the cap are usually arranged to face the cap. Therefore, the parts of the cap cleaner are difficult to be replaced. Furthermore, the parts of the cap cleaner which contact the cap not only absorb the dirt of the cap but also the ink inside the cap. Thus it is necessary to replace the cap cleaner to clean the cap.

It is known in Japanese patent publication numbers 2011-25621 to use a wiper cleaner made of absorbing material that cleans the nozzle face of a print head, a wiper, and the cap. The wiper cleaner has a belt wound around a supply roller and winding roller. The belt is conveyed so that the unused part of the cap cleaner contacts and cleans the nozzle face and the wiper.

However, this wiper cleaner has to be replaced after using it because the wiper cleaner absorbs ink and waste liquid during the cleaning process. To replace the wiper cleaner, it is necessary to wind the roller while the wiper cleaner faces the nozzle face, and this increases working process. Furthermore, in order to keep the recording performance of the image forming apparatus for a long time, it is necessary to increase the winding number of the wiper cleaner, and this further increases the difficulty of replacing the wiper cleaner.

BRIEF SUMMARY OF THE INVENTION

The present invention provides an improved liquid discharger capable of cleaning a cap and cap cleaner. The liquid discharger according to preferred embodiments of the present invention includes a head to discharge liquid droplets; a cap to cover a nozzle face of the head; and a cap mover to move the cap to a capping position at which the cap faces the nozzle face of the head or to move the cap to an evacuation position at which the cap does not face the nozzle face of the head. Further, there is a belt arranged to face the cap at the evacuation position, the belt having a width and length enough to cover whole area of a rim of the cap. Additionally, there is a conveyer to drive the belt and a belt cleaner arranged to face the belt to clean the belt.

DETAILED DESCRIPTION OF THE INVENTION

Hereinafter, preferred embodiments of the present invention will now be described with reference to accompanying drawings.

The First Embodiment

Figure 1:
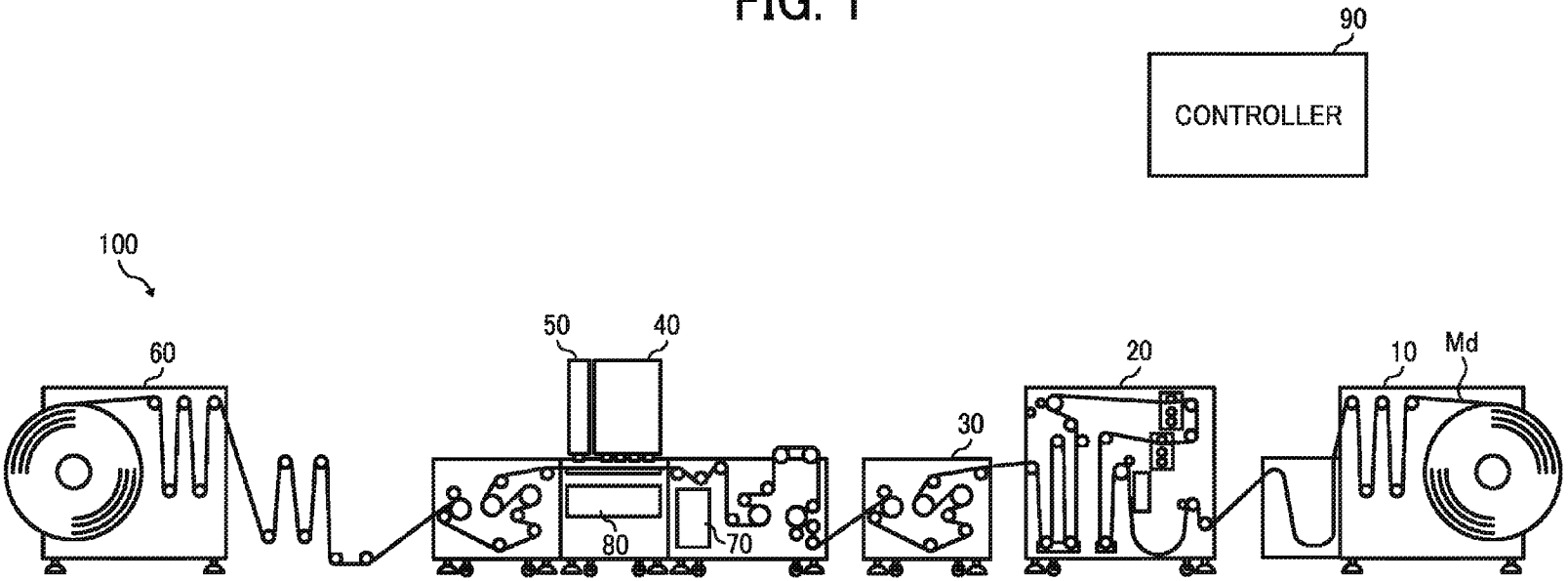
FIG. 1 is a schematic view of a liquid discharger according to a first embodiment of the present invention.

FIG. 1 is a schematic view illustrating a liquid discharger including a head to discharge liquid droplet and form an image on a recording medium. As shown in FIG. 1, the liquid discharger 100 has a supplier 10, a pre-processer 20, a dryer 30, an image former 40, a post-processer 50, a winder 60, a liquid holder and supplier 70, a head maintainer 80, and controller 90. The controller 90 is connected to one or more of the elements of FIG. 1. The controller may be implemented using a programmed processor and/or special purpose circuitry.

A roll sheet Md as a recording medium is a continuous sheet, which is rolled and has a perforation, at which the roll sheet can be easily cut, formed in predetermined distances.

The supplier 10 supplies the roll sheet to the pre-processor 20. The pre-processor 20 pre-processes a surface of the supplied roll sheet Md and sends the roll sheet Md to the dryer 30. The dryer 30 dries the surface of the roll sheet Md and sends it to the image former 40.

The image former 40 forms images on the recording medium. The head of the image former 40 discharges liquid, called ink hereinafter, on the surface of the roll sheet Md, which is pre-processed and dried, to form images.

The liquid holder and supplier 70 stirs the liquid to unify the concentration of liquid and supplies liquid to the head of the image former 10.

The image formed roll sheet Md is sent to the post-processor 50. Post-processor 50 post-processes the image formed roll sheet Md and sends it to the winder 60. The winder 60 winds the roll sheet Md. The controller 90 controls the series of processes explained above.

In this patent specification, "sheet" is not limited to the paper material, but also includes an OHP sheet, fabrics, boards, film, metallic sheet, etc., on which ink droplets or other liquid are deposited. The term "sheet" is a collective term for a recorded medium, recording medium, recording sheet, and the like. The term "sheet" is not limited to the roll sheet, it can be cut sheet, ordinary sheet, cardboard, thin-paper, and fine paper.

Figure 2:
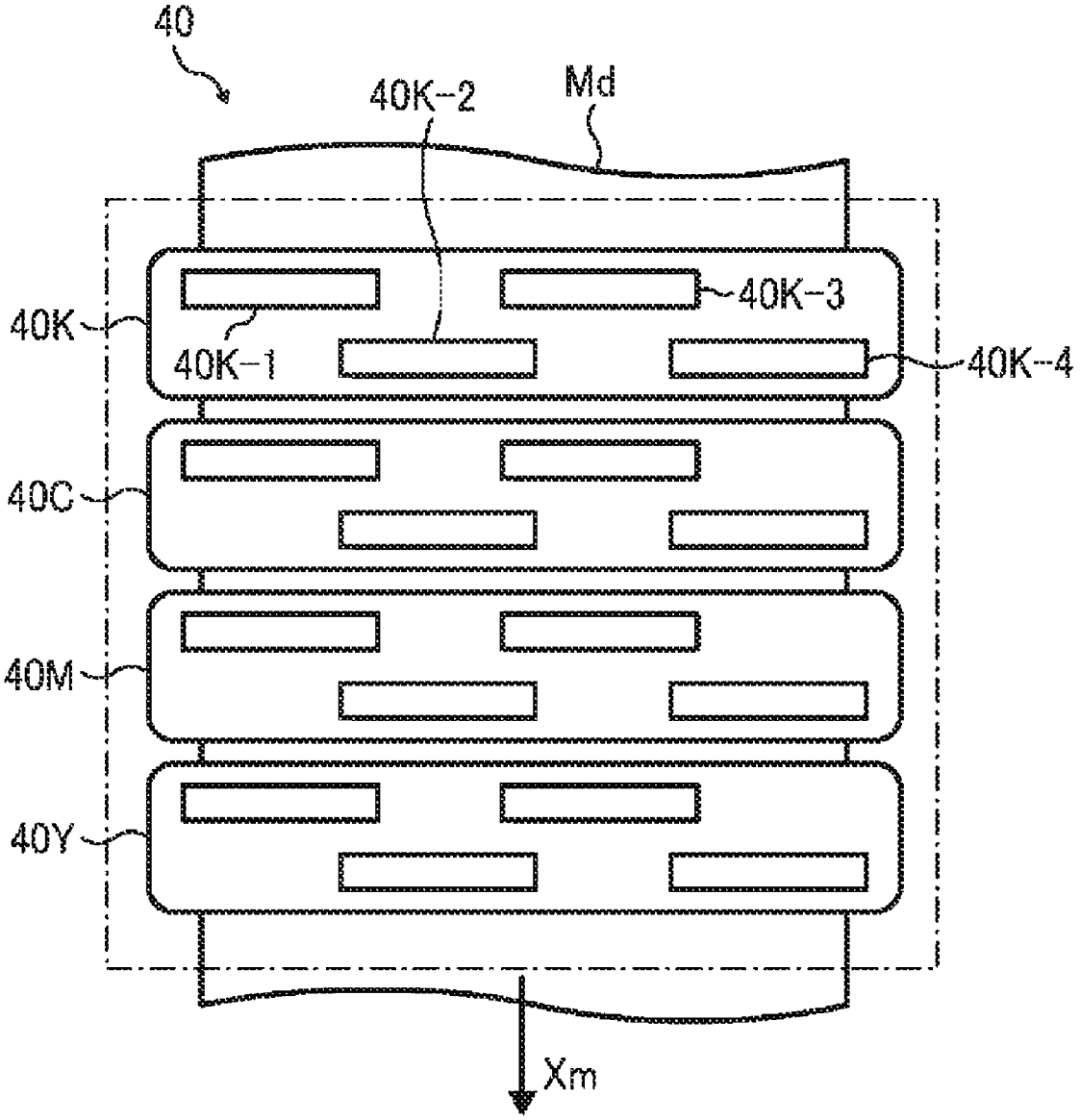
FIG. 2 is a schematic plan view of the liquid discharger.

FIG. 2 is a schematic plan view of the liquid discharger. As shown in FIG. 2, the image former 40 has four head units 40K, 40C, 40M, and 40Y corresponding to black, cyan, magenta, and yellow ink arranged in parallel along a convey direction Xm of the roll sheet Md shown by an arrow in FIG. 2. Each of the head units 40K, 40C, 40M, and 40Y has a plurality of heads that are arranged in a direction perpendicular to the convey direction Xm to cover whole width of the roll sheet. For example, the head unit 40K has four heads 40K-1, 40K-2, 40K-3, and 40K-4. The head unit 40K discharges black ink. The head unit 40C discharges cyan ink. The head unit 40M discharges magenta ink. The head unit 40Y discharges yellow ink. The four head units 40K, 40C, 40M, and 40Y are arranged in this order along a convey direction Xm of the roll sheet Md shown by an arrow in FIG. 2. However the arrangement of each head units 40K, 40C, 40M, and 40Y can be different. Furthermore, the image former 40 can have a head unit that discharges green ink, red ink, light cyan, and ink of any other color. The image former 40 can have head units of a single color, such as black.

Here, the four heads 40K-1, 40K-2, 40K-3, and 40K-4 of the head unit 40K are arranged in a staggered manner in a direction perpendicular to the convey direction Xm of the roll sheet Md. Thus, the head unit 40K can form a black (K) image all over the image forming region (printing region) of the roll sheet Md. The structures of other head units 40C, 40M, and 40Y are same as the head unit 40K, if desired.

Figure 3A:
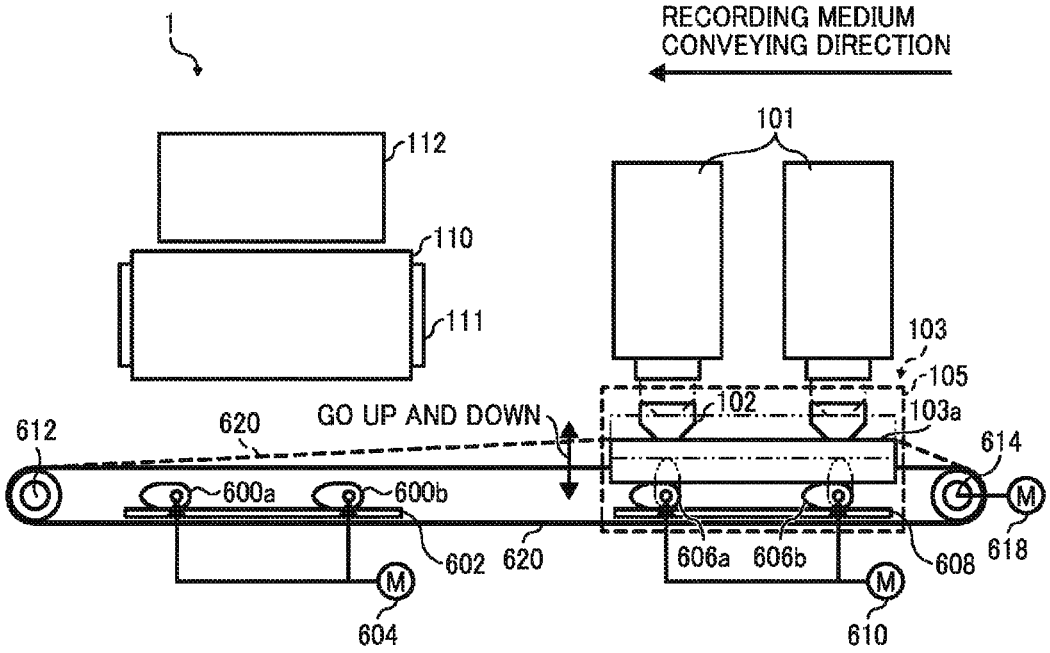
FIGS. 3A and 3B are a schematic view illustrating a main part of the liquid discharger according to the first embodiment of the present invention.
Figure 3B:
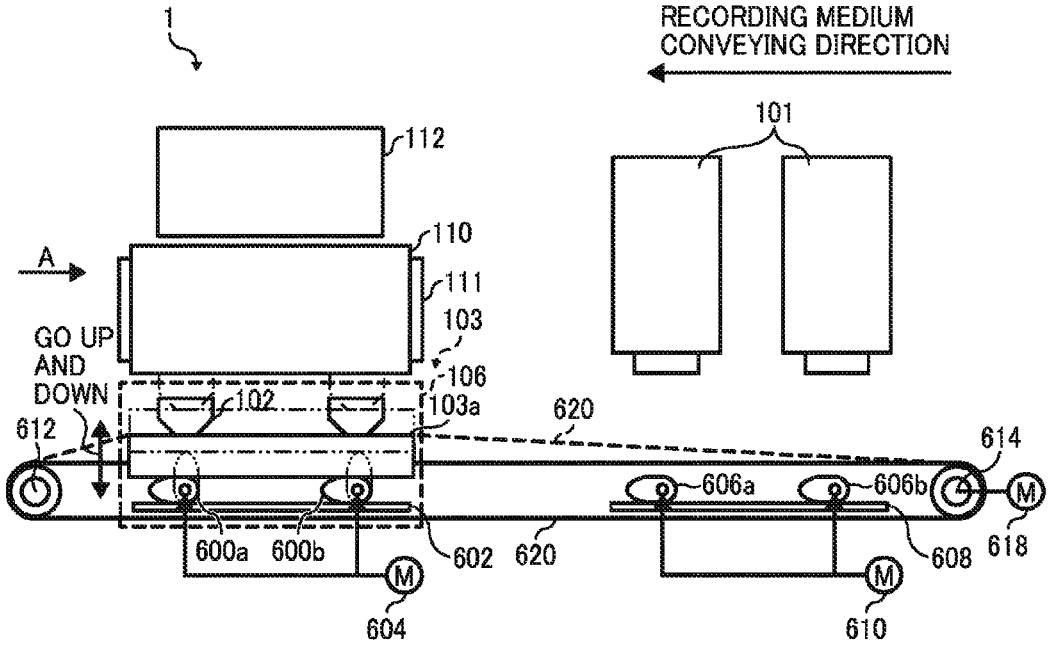

FIGS. 3A and 3B are schematic views illustrating a main part of the liquid discharger according to the first embodiment of the present invention. The liquid discharger 1 has a plurality of heads 101 to discharge liquid droplets, caps 102 to cover the nozzle face of the heads 101, and cap mover to move the caps 102 to predetermined positions. Furthermore, the liquid discharger 1 has a belt 110 to remove the objects attached on the caps 102, a conveyer 111 to drive the belt 110, and a belt cleaner 112 to clean the belt 110 by removing objects attached to the belt 110.

The cap mover 103 moves the caps 102 to a capping position 105 (See FIG. 3A) at which the caps 102 faces the nozzle face of the head 101 or moves the caps 102 to an evacuation position 106 (See FIG. 3B) at which the caps 102 does not face the nozzle face of the head 101 along the convey direction Xm of the roll sheet Md. The cap mover 103 also has a mechanism to move the caps 102 vertically.

The cap mover 103 has a cap holder 103*a* to hold the caps 102. The cap mover 103 is moved in a vertical direction by cams 606*a* and 606*b*, a cam base 608, and a cam motor 610 at the capping position 105. Further, the cap mover 103 is moved in a vertical direction by cams 600*a* and 600*b*, a cam base 602, and a cam motor 604 at the evacuation position 106. The cap holder 103*a* is connected to the belt 620, and the cap holder 103*a* moves together with the movement of the belt 620. The belt 620 has a drive roller 614 connected to a motor 618 and driven roller 612. The belt 620 is wound around the drive roller 614 and the driven roller 612. The belt 620 moves by the rotation of the drive roller 614 and the driven roller 612.

The cams 606*a* and 606*b*, a cam base 608, and a cam motor 610 are disposed inside the belt 620 and fixed to the apparatus body at the capping position 105. The cams 600*a* and 600*b*, a cam base 602, and a cam motor 604 are disposed inside the belt 620 and fixed to the apparatus body at the evacuation position 106. The cam motor 610 rotates the cams 606*a* and 606*b* to move the cap holder 103*a* upward and downward when the cap holder is positioned at the capping position 105 as shown in FIG. 3A. The cam motor 604 rotates the cams 600*a* and 60 to move the cap holder 103*a* upward and downward when the cap holder 103*a* is positioned at the evacuation position 106 as shown in FIG. 3B. The cams are connected to their corresponding motor by gears, for example.

When the caps 102 are located at the cap position 105, the cap mover 103 elevates the caps 102 and pushes each of the rims of the caps 102 against the nozzle face of the heads 101 to protect and retain the moisture of the nozzle face of the heads 101. On the other hand, when the heads 101 discharge liquid, the cap mover 103 moves the caps 102 to the evacuation position 106 at which the caps 102 do not face and cover the nozzle face of the heads 101.

The conveyer 111 is provided above the evacuation position 106, and the conveyer 111 drives the belt 110 when the rims of the caps 102 contact the belt 110 to clean the caps 102. The belt cleaner 112 is arranged above the belt 110 and conveyer 111 to face the belt to clean the belt 110.

Figure 4:
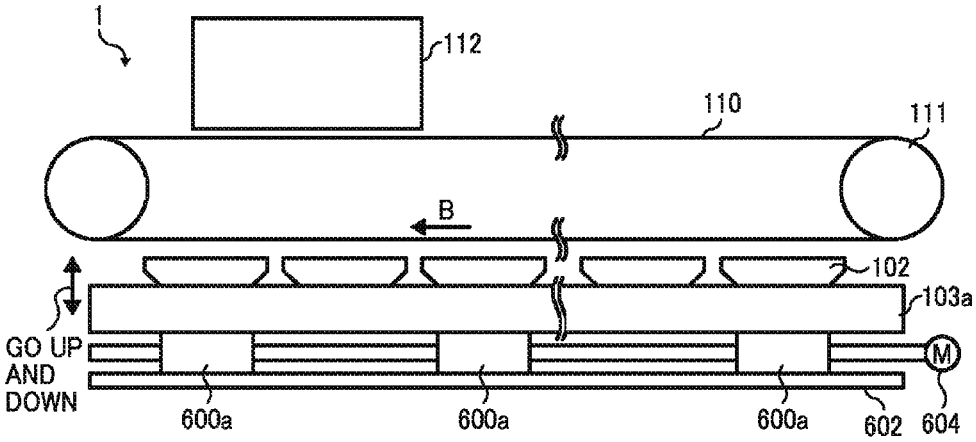
FIG. 4 is a schematic plan view of the main part of the liquid discharger viewed from the direction of arrow A in FIG. 3B.

FIG. 4 is a schematic plan view of the main part of the liquid discharger 1 viewed from the direction of arrow A in FIG. 3B. As shown in FIG. 4, the conveyer 111 conveys the belt 110 laterally (in the direction shown by an arrow B) in the direction perpendicular to the convey direction Xm of the roll sheet Md. The belt 110 has a width and length sufficient to cover the whole area of the rims of the caps 102. The belt 110 is made of elastic and water-resistant material. The belt 110 has a function of removing the dirt or object attached on the rims of the caps 102.

The belt cleaner 112 is arranged above the belt 110 to face the belt 110. The belt cleaner 112 has a brush or air suction mechanism to remove the dirt and other objects attached to the belt 110 to clean the belt 110. The belt cleaner 112 is removable from the liquid discharger 1, and the belt cleaner 112 can be set on the liquid discharger 1 again after disposing the object attached on the belt cleaner 112. Also, only the object attached on the belt cleaner 112 can be removed separately from the belt cleaner 112.

The cleaning process of the caps 102 of the liquid discharger 1 constructed as above will be explained below.

As shown in FIG. 3B, the cap mover 103 moves the caps 102 from the capping position 105 to the evacuation position 106 by driving a belt motor 618 and moving the belt 620. Next, as shown in FIG. 4, the cap mover 103 moves the caps 102 upward so that the rims of the caps 102 contact belt 110 at the evacuation position 106 by driving the cam motor 604 and rotating the cams 600*a* to move the cap holder 103*a* upward. At this time, the belt 110 is not driven and not moving. The belt 110 can thereby move the objects attached on the rim of the caps 102 to the belt 110.

Next, the cap mover 103 moves caps 102 down to separate the caps 102 from the belt 110 by driving the cam motor 604 and rotating the cams 600*a* to move the cap holder 103*a* downward. When the caps 102 are separated from the belt 110, conveyer 111 conveys the belt 110 so that a part of the belt 110, on which the object is attached, is conveyed to the position where the belt cleaner 112 is provided. Then, the belt cleaner 112 cleans the belt 110 by means of a brush or air suction that removes objects from the belt 110. The objects removed from the belt 110 are stored inside the belt cleaner 112, and the objects can be removed from the belt cleaner 112 by detaching the belt cleaner 112 from the liquid discharger 1.

In this way, the belt 110 is cleaned by the belt cleaner 112, so that it is not necessary to replace the belt 110 for a long time. Also, the objects removed from the belt 110 can be removed by replacing or detaching the belt cleaner 112 from the liquid discharger 1. Therefore, the present embodiment makes the process of cleaning the caps 102 easy, and maintaining the discharge function of the heads 101 easy.

As a preferred construction of the present embodiment of the liquid discharger surface of the belt 110 that contacts the caps 102 may have a finely woven mesh. By a capillary phenomenon generated by the finely woven mesh-like shape, the belt 110 can effectively remove and clean the liquid-like objects and solid objects attached to the rim of the caps 102.

Furthermore, removing the object attached inside the belt cleaner 112 can be done during the operation of liquid charger 1.

The Second Embodiment

Figure 5:
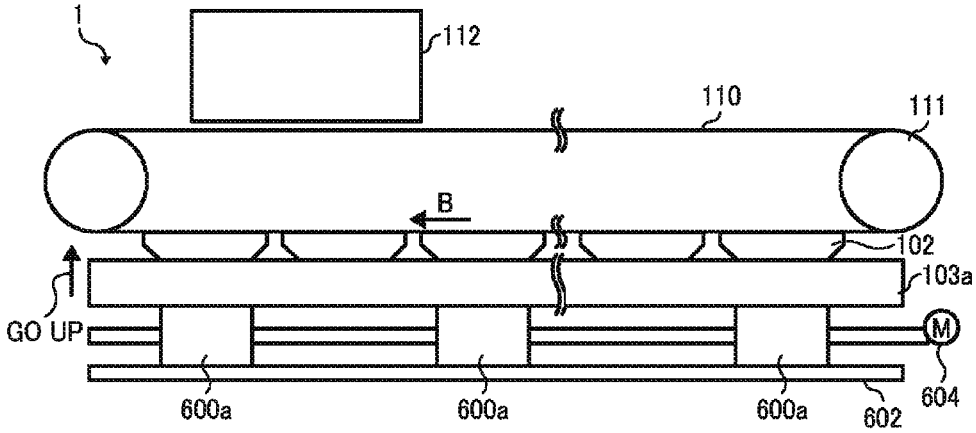
FIG. 5 is a schematic view illustrating a main part of a liquid discharger according to a second embodiment of the present invention.

FIG. 5 is a schematic view illustrating a main part of a liquid discharger according to a second embodiment of the present invention. In FIG. 5, the same code used in FIG. 4 are applied to the elements that are the same as in FIG. 4, and the detailed explanation of which will be omitted.

As shown in FIG. 5, the liquid discharger 1 of the present embodiment uses the belt 110 to keep the moisture inside the caps 102. That is, when the caps 102 are located at the evacuation position 106 as shown in FIG. 3B, the cap mover 103 moves the caps 102 upward and makes the rim of the caps 102 contact the belt 110.

Thereby, even during the liquid discharger 1 discharging liquid from the nozzle of the heads 102, the belt 110 can protect the inside of the caps 102 from the outside environment. Thus, it is possible to protect and to keep the moisture of the nozzle face of the heads 101 in a highly humid condition.

It is preferable that the conveyer 111 does not drive and move the belt 110 when the caps 102 contacts the belt 110. Then, it is possible to reduce abrasion of the contact part between the caps 102 and the belt 110 by avoiding the caps 102 from contacting with belt 110 during the conveying process. However, it is possible for the belt 110 to move relative to the caps 102 during the cleaning process.

The Third Embodiment

Figure 6:
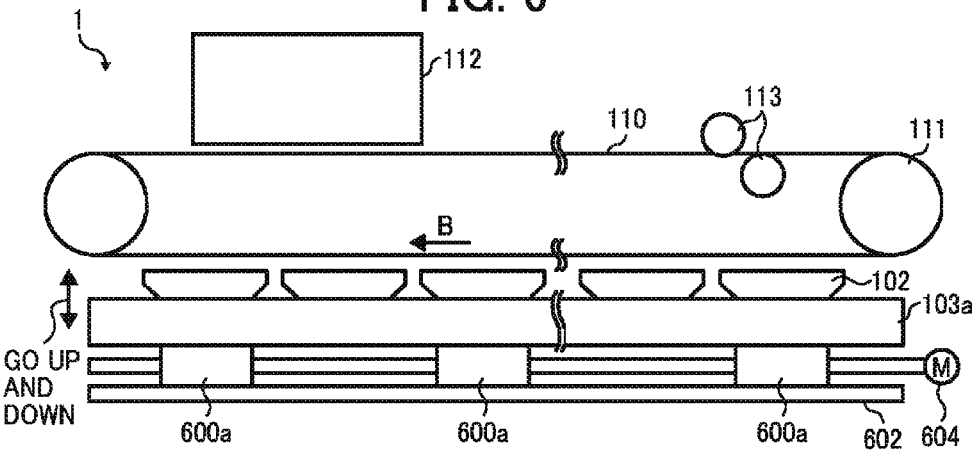
FIG. 6 is a schematic view illustrating a main part of a liquid discharger according to a third embodiment of the present invention.

FIG. 6 is a schematic view illustrating a main part of a liquid discharger according to a third embodiment of the present invention. In FIG. 6, the same reference numerals used in FIG. 4 are applied to the elements that are the same as in FIG. 4, and the detailed explanation of which will be omitted.

As shown in FIG. 6, the liquid discharger 1 of the present embodiment further comprises a tensioner 113 to adjust a tension applied to the belt 110. That is, after the tensioner 113 adjusts the tension applied on the belt 110 properly, the caps 102 contact the belt 110. Because the belt 110 can uniformly contact the caps 102, it is possible to remove the object attached on the rim of the caps 102 effectively.

Figure 7:
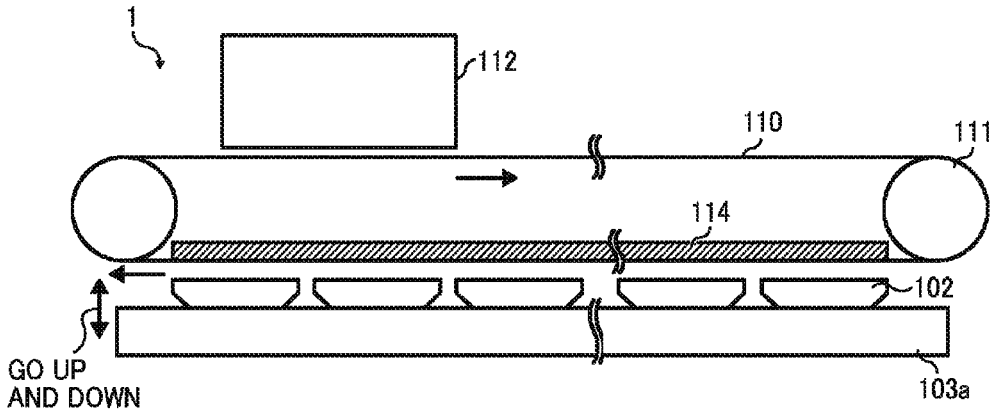
FIG. 7 is a schematic view illustrating a main part of a liquid discharger according to a fourth embodiment of the present invention.

FIG. 7 is a schematic view illustrating a main part of a liquid discharger according to a fourth embodiment of the present invention. In FIG. 7, the same reference numerals used in FIG. 4 are applied to the elements that are the same as in FIG. 4, and the detailed explanation of which will be omitted.

As shown in FIG. 7, the liquid discharger 1 of the present embodiment further comprises a pressurizing plate 114 that applies pressure on the belt 110 against the caps 102 from the back of the belt 110. That is, when the belt 110 contacts caps the 102, the pressurizing plate 114 applies additional pressure on the belt 110 against the caps 102. Because the belt 110 can uniformly contact the caps 102, it is possible to remove the objects attached on the rim of the caps 102 effectively.

The Fifth Embodiment

Figure 8:
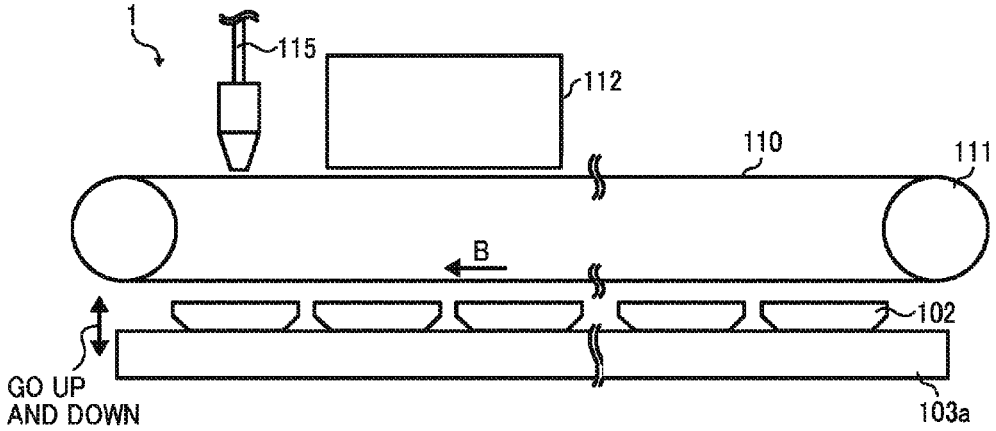
FIG. 8 is a schematic view illustrating a main part of a liquid discharger according to a fifth embodiment of the present invention.

FIG. 8 is a schematic view illustrating a main part of a liquid discharger according to a fifth embodiment of the present invention. In FIG. 8, the same reference numerals used in FIG. 4 are applied to the elements that are the same as in FIG. 4, and the detailed explanation of which will be omitted.

As shown in FIG. 8, the liquid discharger 1 of the present embodiment further comprises an ejector 115 to eject cleaning liquid on the belt 110, and the ejector 115 disposed behind a position where an object attached on the belt 110 arrives at the belt cleaner 112. That is, after the ejector 115 ejects cleaning liquid on the object attached on the belt 110, the belt cleaner 112 cleans the belt 110. Because the belt cleaner 112 cleans the belt 110 after the object attached on the belt 110 is floating on or loosened from the belt 110 by the cleaning liquid, it is possible to remove the objects attached to the belt 110 effectively by the belt cleaner 112.

As cleaning liquid, water may be used. Also, the cleaning liquid may contain, if desired, a water-soluble organic solvent and a surfactant. The surfactant is used for reducing the surface tension of the ink to easily penetrate into a recording medium, or controlling the behavior of the dynamic surface tension. The water-soluble organic solvent is appropriately selected depending on the intended purpose without any limitation, and examples thereof include: 1,3-butanediol, diethylene glycol, triethylene glycol, and glycerin, which prevent jetting failures due to evaporation of moisture.

The Sixth Embodiment

Figure 9:
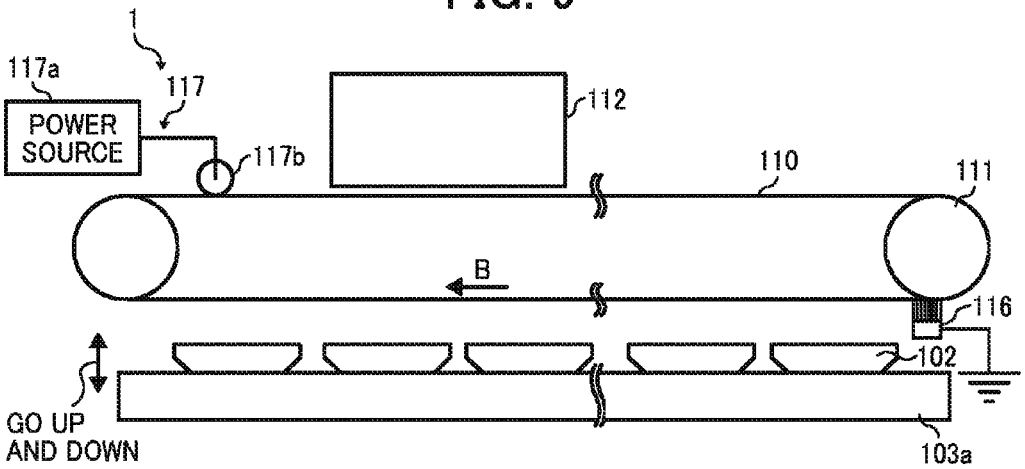
FIG. 9 is a schematic view illustrating a main part of a liquid discharger according to a sixth embodiment of the present invention.

FIG. 9 is a schematic view illustrating as main part of a liquid discharger according to a sixth embodiment of the present invention. In FIG. 9, the same reference numerals used in FIG. 4 are applied to the elements that are the same as in FIG. 4, and the detailed explanation of which will be omitted.

As shown in FIG. 9, the liquid discharger 1 of the present embodiment further comprises a charger 117 to charge the belt 110 and a discharger 116 to discharge electricity on the belt 110. Here, "discharge" means to electrically neutralize a charged object. The charger 117 is provided on the upstream side of the position where the belt 112 faces and contacts the caps 102. In FIG. 9, there are plurality of caps 102, and the charger 117 is provided on the upstream side of the cap 102, which is located most upstream side in the belt convey direction B. In FIG. 9, the charger 117 faces the conveyer 111. The discharger 116 is provided on the upstream side of the belt cleaner 112 in the belt convey direction B.

The charger 117 has a power source 117*a* and a charge roller 117*b* connected to the power source 117*a*. The power source 117*a* supplies AC voltage to the charge roller 117*b* to attract the object attached on the caps 102. The charge roller 117*b* applies AC voltage on the belt 110. The discharger is connected to the earth to release the electricity applied on the belt 110. The power source 117*a* may supply direct voltage to the charge roller 117*b*.

After the charger 116 charges the belt 112, the caps 102 contacts the belt 112 so that the belt removes the object attached on the caps 102. Further, after the discharger 117 discharges electricity on the belt 110, the belt cleaner 112 cleans the belt 110. Thereby the objects attached to the belt 110 can be effectively removed from the belt 110.

The Seventh Embodiment

Figure 10A:
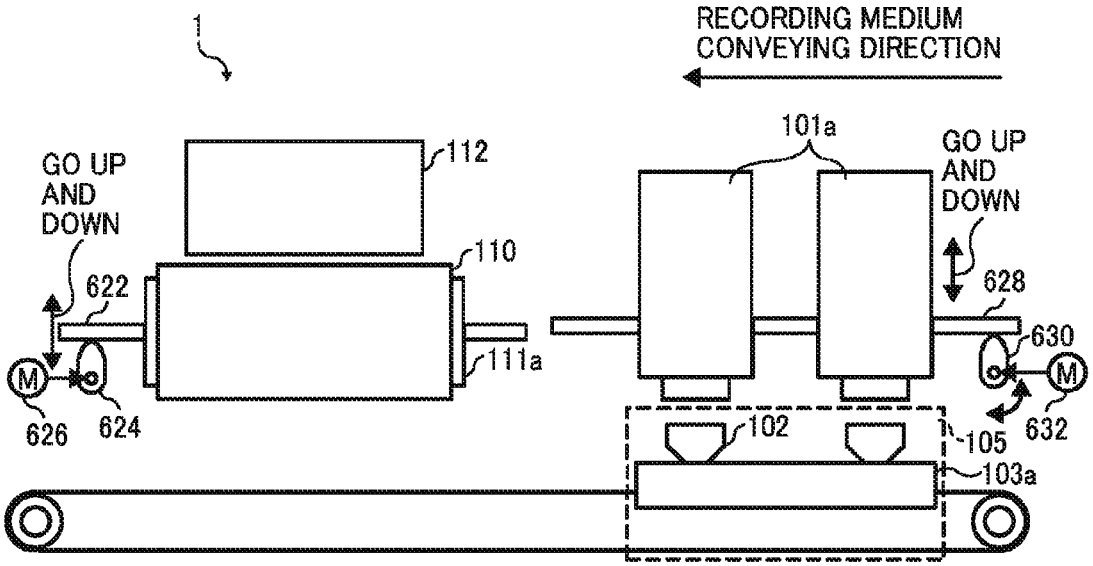
FIGS. 10A and 10B are schematic views illustrating a main part of a liquid discharger according to a seventh embodiment of the present invention.
Figure 10B:
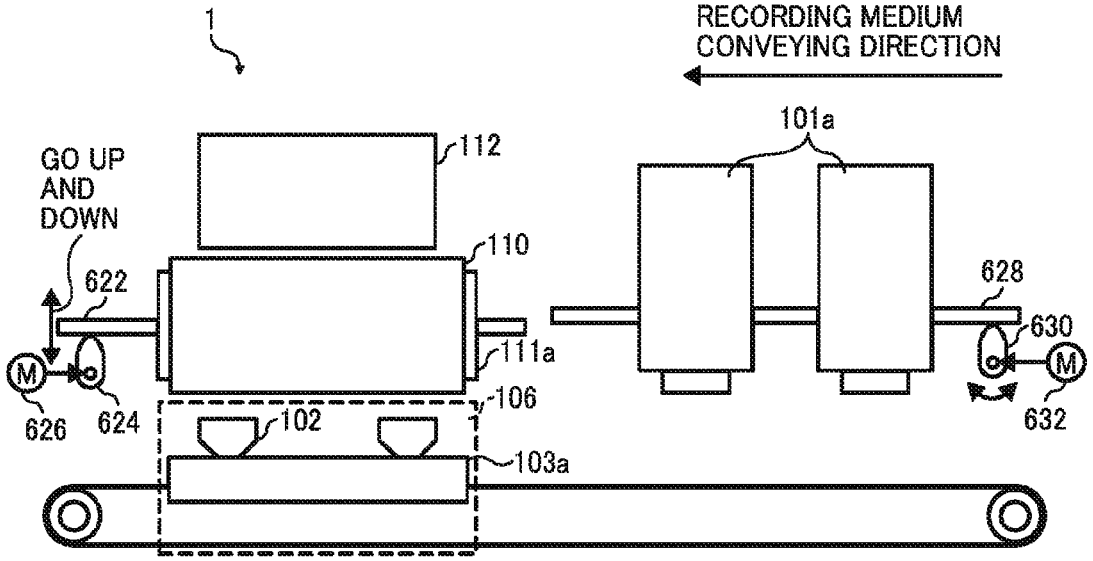

FIGS. 10A and 10B are schematic views illustrating a main part of a liquid discharger 1 according to a seventh embodiment of the present invention. In FIGS. 10A and 10B, the same reference numerals used in FIGS. 3A and 3B are applied to the elements that are the same as in FIGS. 3A and 3B, and the detailed explanation of which will be omitted.

As shown in FIGS. 10A and 10B, the liquid discharger 1 of the present embodiment further has a conveyer 111*a* that not only drives and convey the belt 110, but also moves the belt 110 upward and downward vertically. Furthermore, the heads 101*a* move upward and downward vertically, so that the caps 102 can cover the nozzle face of the heads 101*a*. The cap mover 103*a* moves the caps 102 along the convey direction Xm of the roll sheet Md.

The belt 110 has a cam 624 and a motor 626 to rotate the cam 624. The controller 500 drives the motor 626 and rotates the cam 624. The cam 624 contacts a shaft 622 of the conveyer 111*a* and moves the belt 110 upward or downward by the rotation of the cam 624. Further, the heads 101*a* have a cam 630 and a motor 632 to rotate the cam 630. The controller 500 drives the motor 632 and rotates the cam 630. The cam 630 contacts a holder 628 of the heads 101*a* and moves the heads 101*a* upward or downward by the rotation of the cam 630.

Using the configuration shown in FIGS. 10A and 10B, it is possible to cover the nozzle faces of the heads 101*a* by the caps 102. Furthermore, the conveyer 111*a* moves the belt 110 upward or downward vertically, thus the conveyer 111*a* can move the belt 110 to contact with or separate from the caps 102. Therefore, the belt 110 can remove the object attached on the rim of the caps 102 to clean the caps 102.

Furthermore, the second embodiment shown in FIG. 5, the third embodiment shown in FIG. 6, and the fourth embodiment shown in FIG. 7, the fifth embodiment shown in FIG. 8, and the sixth embodiment shown in FIG. 8 may have the conveyer 111*a* that moves the belt 110 upward or downward vertically to contact or separate the belt 110 with the caps 102.

The liquid discharger 1 may have both of the conveyer 111*a* that moves the belt 110 upward or downward vertically, and a cap mover that moves the caps 102 upward or downward vertically.

The liquid discharger 1 may have a controller 90 to keep the caps 102 and the belt 10 to contact with each other during the caps 102 being positioned at the evacuation position 106.

The term "liquid discharger" means a device for discharge liquid by transmitting, ejecting, discharging, or impacting liquid droplets towards a surface such as media including paper, thread, fiber, fabric, leather, metals, plastics, glass, wood, ceramics and the like.

The "liquid" includes ink, but it is not limited to so-called ink, but it is used as an inclusive term for every liquid such as recording liquid, fixing liquid, and aqueous fluid to be used for image formation, which further includes, for example, DNA samples, registration and pattern materials and resins.

Further, the liquid discharger includes, otherwise limited in particular, any of a serial-type liquid discharger that scans the head during discharging liquid, and a line-type liquid discharger having a single head or plurality of heads arranged to cover the whole width of the roll-sheet and does not move the head during discharging liquid. Further, the invention includes alternative embodiments which are combinations of any or all of the features disclosed herein.

Additional modifications and variations of the present invention are possible in light of the above teachings. It is therefore to be understood that, within the scope of the appended claims, the invention may be practiced other than as specifically described herein.

What is claimed is:

1. A liquid discharger, comprising:

a head to discharge liquid droplets;

a cap to cover a nozzle face of the head;

a cap mover to move the cap to a capping position at which the cap faces the nozzle face of the head or to move the cap to an evacuation position at which the cap does not face the nozzle face of the head;

a belt which faces and cleans the cap at the evacuation position, the belt having a width and length to at least cover an entire rim of the cap;

a conveyer to drive the belt; and a belt cleaner which faces the belt to clean the belt.

2. The liquid discharger as claimed in claim wherein:

the cap mover moves the cap laterally to the capping position or to the evacuation position, and the cap mover moves the cap vertically until the rim of the cap contacts the belt when the cap is positioned at the evacuation position.

3. The liquid discharger as claimed in claim 1, wherein the belt moves vertically toward the cap until the rim of the cap contacts the belt.

4. The liquid discharger as claimed in claim 1, wherein both of the cap and the belt move vertically toward each other until the rim of the cap contacts the belt.

5. The liquid discharger as claimed in claim 1, further comprising:

a controller to keep the cap and the belt in contact with each other when the cap is being positioned at the evacuation position.

6. The liquid discharger as claimed in claim 1, further comprising:

a controller to control the liquid discharger such that the conveyer does not drive the belt while the rim of the cap contacting the belt.

7. The liquid discharger as claimed in claim 1, wherein the belt includes an elastic and water-resistant material.

8. The liquid discharger as claimed in claim 1, wherein a surface of the belt that contacts the cap includes a mesh shape.

9. The liquid discharger as claimed in claim 1, further comprising:

a tensioner to adjust a tension applied to the belt.

10. The liquid discharger as claimed in claim 1, further comprising:

a pressurizing plate that applies pressure on the belt against the cap from an inside of the belt.

11. The liquid discharger as claimed in claim 1, further comprising:

an ejector to eject cleaning liquid on the belt, the ejector being disposed behind a position where an object attached on the belt arrives at the belt cleaner.

12. The liquid discharger as claimed in claim 1, further comprising:

a charger to charge the belt, the charger disposed upstream side of the position where the belt contacts the cap in a belt convey direction;

a discharger to discharge electricity on the belt, the discharger disposed upstream side of the belt cleaner in a belt convey direction.

* * * * *